US005591320A

United States Patent [19]

Rolander

[11] Patent Number: 5,591,320

[45] Date of Patent: Jan. 7, 1997

[54] METHOD FOR OBTAINING WELL DEFINED EDGE RADII ON CUTTING TOOL INSERTS BY ELECTROPOLISHING TECHNIQUE

[75] Inventor: Ulf Rolander, Bromma, Sweden

[73] Assignee: Sandvik AB, Sandviken, Sweden

[21] Appl. No.: 566,952

[22] Filed: Dec. 4, 1995

[30] Foreign Application Priority Data

Dec. 12, 1994 [SE] Sweden ..... 9404326

[51] Int. Cl.[6] ..... C25F 3/16

[52] U.S. Cl. ..... 205/664; 205/684

[58] Field of Search ..... 205/664, 676, 205/684, 678, 674

[56] References Cited

U.S. PATENT DOCUMENTS

| | | | |
|---|---|---|---|
| 2,752,304 | 6/1956 | Darmois et al. | 205/676 |
| 3,578,573 | 5/1971 | Schweigert et al. | 205/676 |
| 4,169,026 | 9/1979 | Kikuchi et al. | 205/661 |
| 4,217,190 | 8/1980 | Neal et al. | 205/652 |
| 4,405,422 | 9/1983 | Blomsterberg | 205/676 |
| 4,406,759 | 9/1983 | Saitoh | 205/664 X |
| 4,411,751 | 10/1983 | Blomsterberg | 205/676 |
| 4,710,279 | 12/1987 | Hozer | 205/664 |
| 5,213,667 | 5/1993 | Hozer | 205/664 |
| 5,334,294 | 8/1994 | Iwai et al. | 205/664 X |
| 5,380,408 | 1/1995 | Svensson | 427/249 |

FOREIGN PATENT DOCUMENTS

| | | |
|---|---|---|
| 3111600 | 5/1991 | Japan . |

*Primary Examiner*—Donald R. Valentine

*Attorney, Agent, or Firm*—Burns, Doane, Swecker & Mathis, L.L.P.

[57] ABSTRACT

There is disclosed a method for edge rounding of cutting tool inserts of cemented carbide or titanium based carbonitride alloys. An electrolytic method is used with an electrolyte which provides an even removal of both binder phase and hard constituent phases. The electrolyte comprises perchloric ($HC10_4$) sulphuric ($H_2SO_4$) acid, 2–15 vol %, and mixtures thereof in methanol or other suitable organic liquid. The method is easier to control than conventional mechanical methods and is particularly useful for providing very small edge radii of about 10 μm which cannot be made by mechanical methods.

6 Claims, 1 Drawing Sheet

METHOD FOR OBTAINING WELL DEFINED EDGE RADII ON CUTTING TOOL INSERTS BY ELECTROPOLISHING TECHNIQUE

BACKGROUND OF THE INVENTION

The present invention relates to a method for obtaining well defined edge radii on cutting tool inserts by electropolishing technique.

Inserts for chip forming machining made of cemented carbides or titanium-based carbonitrides (cermets) have at least one main cutting edge and a connecting nose (corner). Such inserts are produced by the powder metallurgical methods of milling of powders of the hard constituents and binder phase, pressing to form bodies of a desired shape and finally sintering the pressed bodies. The pressing is generally done by tool pressing between two opposing punches in a die. As a result of the pressing operation, the inserts have rather sharp edges. In addition, because of the small gap, a few microns wide that always exists between the punches and the die wall, the insert edges also have burrs. Such edges break too easily when used.

Therefore, after sintering, the inserts are subjected to an edge rounding operation including mechanical methods such as lapping, tumbling, brushing or blasting. These operations, however, are difficult to control with desirable accuracy. For this reason, the edge rounding values usually range between 30 and 75 μm on cemented carbide inserts for a majority of machining applications. Smaller edge rounding values are generally not possible to obtain with mechanical methods. Also, the edges often get defects in the initial stage of the mechanical operation. These detects disappear during the continued treatment provided that the final edge rounding obtained is larger than the defect size.

A finer edge rounding, however, means lower cutting forces. The choice of edge rounding is a compromise between the desired edge strength and acceptable cutting forces. For certain cutting operations such as threading and machining of heat resistant materials, aluminum or cast iron, low cutting forces are desirable. However, the above mentioned methods for edge rounding are generally not useful, at least on a large, industrial scale.

Electrolyte smoothing or deburring is a commonly employed technique. Two well-known processes are called electrochemical deburring and electropolishing. U.S. Pat. No. 4,405,422 discloses methods for electrolyte deburring of copper or copper alloys and U.S. Pat. No. 4,411,751 of steel or aluminum alloys. However, when subjecting materials with phases of differing chemical properties such as cemented carbide to chemical treatments. The metallic binder phase is often dissolved first, resulting in a porous surface layer with reduced strength and often containing portions comprising several grains that have disappeared, (so-called pitting). It is therefore essential that an electrolyte is used which provides an even removal of material, essentially without depth effect. An example of this is U.S. Pat. No. 5,380,408, (our reference: 024000-819)incorporated by reference herein, which discloses a method for removing cobalt from the surface of cemented carbide using an electrolyte of sulphuric and phosphoric acids. This method, however, but does not generate edge rounding since it only removes cobalt, leaving the carbide or carbonitride grains intact.

OBJECTS AND SUMMARY OF THE INVENTION

It is all object of this invention to avoid or alleviate the problems of the prior art.

A primary object of the invention is to provide a method for edge rounding of cutting tool inserts which can be more carefully controlled.

A second object of the present invention is to provide a method of manufacturing inserts with a small edge radius of the order of 10 μm.

The invention provides a method for edge rounding of cutting tool inserts of cemented carbide or titanium based carbonitride alloys comprising an electrolyte selected from the group consisting of 2–15 vol % perchloric ($HC10_4$), sulphuric ($H_2SO_4$) acid and mixtures thereof, in an organic liquid carrier;

submerging said inserts into the electrolyte;

providing an electrode of an acid resistant material within the electrolyte;

applying an electrical potential between the inserts and the electrode for a period of time sufficient to round the edges of said inserts to a desired degree.

BRIEF DESCRIPTION OF THE DRAWINGS

FIG. I is a SEM-image in 600 X magnification of the edge of a cemented carbide cutting tool insert treated according to a prior art electrolyte method disclosed in U.S. Pat. No. 4,411,751.

DETAILED DESCRIPTION OF THE PREFERRED EMBODIMENTS OF THE INVENTION

Figure 1:
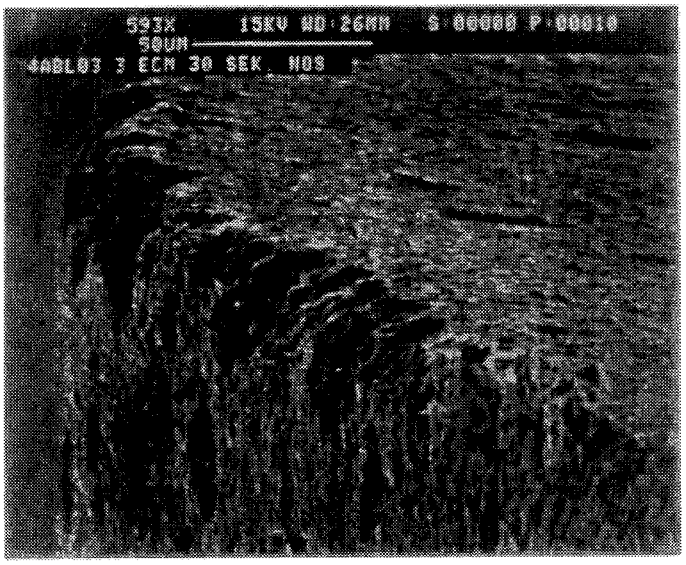
FIG. 1 PRIOR ART

It has now surprisingly been found that by using a method similar to the one disclosed in U.S. Pat. Nos. 4,405,422 and 4,411,751 but using an electrolyte comprising perchloric ($HC10_4$) or sulphuric ($H_2SO_4$) acid, and mixtures thereof, an even removal of the burr and rounding of the edge is obtained, resulting in a smooth edge with an edge rounding which is essentially constant around the insert. The method is easier to control than conventional mechanical methods and is particularly useful for providing very small edge radii of about 10 μm which cannot be made by mechanical methods.

According to the presently claimed invention, the inserts are thoroughly cleaned, e.g., by ultrasonic cleaning in methanol, so that dust, loose particles, grease stains, etc., that may affect the electropolishing result are removed from the surfaces. The inserts are then submerged in the electrolytic bath and a DC-voltage is applied between the inserts (anode) and a cathode. Strong agitation is carried out in order to obtain stable conditions with electrolyte flowing along all sides of the inserts. The cathode should be made of an acid resistant material, e.g., platinum or acid resistant stainless steel, and have a surface area comparable to or preferably larger than the total surface area of the inserts.

The electrolyte should be 2–15 vol % perchloric ($HC10_4$) or sulphuric ($H_2SO_4$) acid, or a mixture thereof, in methanol. Methanol may be partly or fully substituted by more viscous organic fluids, e.g., another lower alkanol such as butanol or glycerol or ethyleneglycol-monobutyl-ether, in order to decrease the electropolishing speed or to obtain more stable conditions.

The temperature of the electrolyte may be varied between room temperature and −60° C., mainly in order to change the viscosity of the electrolyte.

The voltage shall be between +10 and +40 volts. The proper choice of voltage depends on the design of the equipment used, the degree of agitation obtained and the choice of electrolyte and temperature. Electropolishing time is generally from about 5 seconds to about 5 minutes.

With a correct choice of the different parameters described above, a thin, highly viscous layer is formed at the interface between insert and electrolyte. Since the voltage drop occurs mainly across this layer, the electropolishing speed will depend strongly on its thickness. Therefore, on a rough surface, protruding parts will be electropolished faster than grooves, leading to a continuously decreasing surface roughness. On the other hand, if the choice of parameters is too far from the optimum, the viscous layer will never be formed or will be unstable, leading to oxidation or even pitting of the surface.

The choice of electrolyte, temperature, applied voltage and electropolishing time should be adapted for each insert grade to obtain the best result. It is within the purview of the skilled artisan to determine these conditions.

Immediately after electropolishing, the inserts are rinsed, e.g., in methanol, in order to avoid corrosion caused by the electrolyte.

The method is suitable for mass production since large quantities of inserts can be electropolished simultaneously with high electropolishing speed. The accuracy and reproducibility is extremely high.

Edge detects due to pressing or grinding will decrease in size or even vanish depending on the size relation between defect and final edge radius.

For geometrical reasons, the material removal rate is substantially larger along the edges than on the flat surfaces of the insert. Thus, the method can be used also for gradient sintered grades, i.e., grades with a binder please enriched surface layer, without risk that the gradient is removed.

The invention is additionally illustrated in connection with the following Examples which are to be considered as illustrative of the present invention. It should be understood, however, that the invention is not limited to the specific details of the Examples.

EXAMPLE 1

Figure 2:
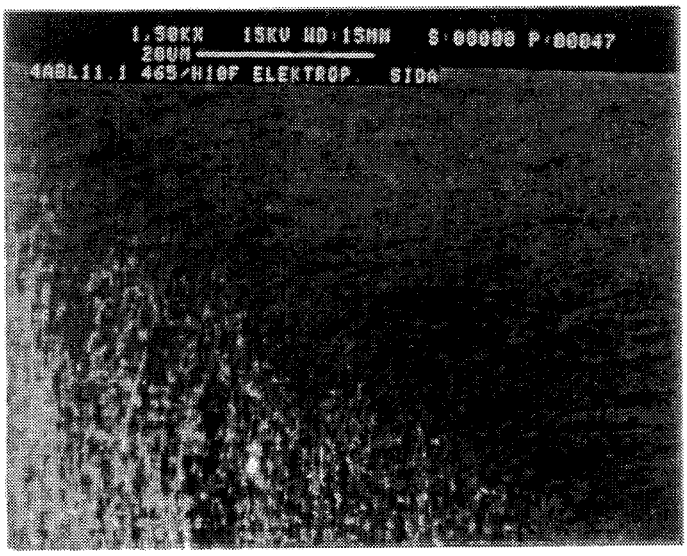
FIG. 2 is a corresponding image in 1500 X of a cemented carbide cutting tool insert edge rounded according to the present invention.

A commercially available cemented carbide insert (SANDVIK H10F) with as sintered sharp edges was electropolished for 15 seconds using an electrolyte consisting of 5 vol % sulphuric acid in methanol, cooled to −20° C., and a DC-voltage of 20 volts. A 30 $cm^2$ platinum sheet was used as cathode and the electrolyte was stirred strongly using a magnetic mixer. Smooth rounded edges were obtained with small edge radii about 10 μm and considerably improved surface finish as shown in FIG. 2.

EXAMPLE 2

Figure 3:
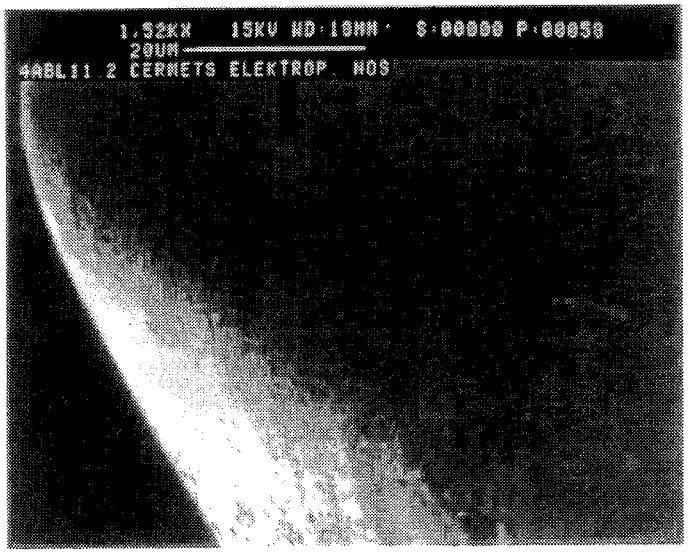
FIG. 3 is a corresponding image to FIG. 2 of a cermet cutting tool insert.

A commercially available cermet insert (SANDVIK CT530) with sharp edges (after grinding of the flat surfaces) was electropolished under identical conditions as above. Smooth rounded edges were obtained with small edge radii about 10 μm and considerably improved surface finish as shown in FIG. 3.

EXAMPLE 3

A commercially available cermet insert (SANDVIK CT530) with sharp edges (also after grinding) was electropolished using an electrolyte consisting of 5 vol % perchloric ($HC10_4$) acid and 35 vol % n-butanol in methanol, cooled to −30° C., and a DC-voltage of 22.5 volts. The other conditions were identical as above. Smooth rounded edges were obtained with small edge radii of about 10 μm and considerably improved surface finish essentially similar to FIG. 3.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. An electropolishing method for edge rounding of cutting tool inserts of cemented carbide or titanium based carbonitride alloys in an electrolyte comprising 2–15 volume % of an acid selected from the group consisting of perchloric ($HC10_4$) acid, sulphuric ($H_2SO_4$) acid and mixtures thereof, in an organic liquid carrier comprising;

submerging said inserts into the electrolyte;

providing an electrode of an acid resistant material within the electrolyte;

applying an electrical potential between the inserts and the electrode for a period of time sufficient to round the edges of said inserts to a desired degree.

2. The method of claim 1, wherein all edge rounding of about 10 μm is obtained.

3. The method of claim 1, wherein the organic liquid carrier is a lower alkanol.

4. The method of claim 3, wherein the organic liquid carrier is methanol.

5. The method of claim 1, wherein the electrode is made of platinum.

6. The method of claim 1, wherein the electrical potential is applied at a voltage of 10 to 40 volts.

* * * * *